US007007869B2

(12) United States Patent
Lewentz et al.

(10) Patent No.: US 7,007,869 B2
(45) Date of Patent: Mar. 7, 2006

(54) SEAL BETWEEN ELEMENTS OF A FUEL-INJECTION NOZZLE FOR AN INTERNAL COMBUSTION ENGINE

(75) Inventors: Günter Lewentz, Regensburg (DE); Klaus Rübling, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 99 days.

(21) Appl. No.: 10/632,633

(22) Filed: Aug. 1, 2003

(65) Prior Publication Data

US 2004/0021012 A1 Feb. 5, 2004

Related U.S. Application Data

(63) Continuation of application No. PCT/DE02/00400, filed on Feb. 4, 2002.

(30) Foreign Application Priority Data

Feb. 6, 2001 (DE) ..... 101 05 368

(51) Int. Cl.

| | |
|---|---|
| ***F02M 59/00*** | (2006.01) |
| ***F02M 61/00*** | (2006.01) |
| ***F02M 63/00*** | (2006.01) |
| ***F02M 39/00*** | (2006.01) |
| ***F02M 41/00*** | (2006.01) |

(52) U.S. Cl. ..... 239/533.2; 239/533.3; 239/533.9; 239/533.11; 239/88

(58) Field of Classification Search ..... 239/533.2, 239/533.3, 533.9, 533.11, 88, 89–92, 585.1, 239/585.2, 585.3, 585.4, 585.5

See application file for complete search history.

(56) References Cited

U.S. PATENT DOCUMENTS

| | | | | |
|---|---|---|---|---|
| 4,202,500 A | * | 5/1980 | Keiczek | 239/533.3 |
| 5,033,716 A | | 7/1991 | Mesenich | 251/129.21 |
| 5,205,492 A | * | 4/1993 | Khinchuk | 239/533.4 |
| 5,697,154 A | | 12/1997 | Ogihara | 29/890.142 |

(Continued)

FOREIGN PATENT DOCUMENTS

| | | | |
|---|---|---|---|
| DE | 567230 | 1/1933 | 46/103 |

(Continued)

OTHER PUBLICATIONS

PCT International Search report for PCT/DE03/01239, 3 pages, Mailed Aug. 21, 2003.

*Primary Examiner*—David A. Scherbel
*Assistant Examiner*—Darren Gorman
(74) *Attorney, Agent, or Firm*—Baker Botts L.L.P.

(57) ABSTRACT

A fuel-injection nozzle for an internal combustion engine is disclosed. The nozzle comprises a nozzle body (2), in which a nozzle needle (10) with a stop (34) is positioned so that it can be displaced, and a nozzle holder (6), in which a pressure pin (16) is displaceably mounted. A disc-shaped stop element (26) is provided in a zone between the nozzle body (2) and the nozzle holder (6). The nozzle body (2) and the nozzle holder (6) are axially braced against one another in such a way that the stop element (26) forms a first sealing surface (30), which lies adjacent to one section (23) of the nozzle holder and a second sealing surface (31), which lies adjacent to one section (24) of the nozzle body. Both the first and second sealing surfaces (30, 31) respectively have at least one cavity (36), which is punched, drilled and/or stamped.

17 Claims, 4 Drawing Sheets

U.S. PATENT DOCUMENTS

| | | | | | |
|---|---|---|---|---|---|
| 5,826,793 | A | * | 10/1998 | Askew | 239/124 |
| 5,897,058 | A | * | 4/1999 | Coldren et al. | 239/88 |
| 6,142,122 | A | | 11/2000 | Hoppenstedt | 123/469 |
| 6,182,912 | B1 | | 2/2001 | Müller | 239/585.1 |

FOREIGN PATENT DOCUMENTS

| | | | |
|---|---|---|---|
| DE | 19900508 | A1 | 7/2000 |
| DE | 19915885 | A1 | 10/2000 |
| DE | 19940387 | C1 | 2/2001 |
| DE | 10017113 | A1 | 10/2001 |
| DE | 10036137 | A1 | 2/2002 |
| EP | 0 637 686 | B1 | 7/1994 |
| EP | 0 799 991 | A1 | 3/1997 |
| EP | 0 957 262 | A2 | 5/1999 |
| GB | 423126 | | 1/1935 |
| JP | 04058061 | A | 2/1992 |
| WO | 99/10648 | | 3/1999 |
| WO | WO 00/60233 | | 10/2000 |
| WO | 03/062630 | | 7/2003 |
| WO | 03/087567 | | 10/2003 |

* cited by examiner

SEAL BETWEEN ELEMENTS OF A FUEL-INJECTION NOZZLE FOR AN INTERNAL COMBUSTION ENGINE

CROSS REFERENCE TO RELATED APPLICATION

This application is a continuation of copending International Application No. PCT/DE02/00400 filed Feb. 4, 2002 and claiming a priority date of Feb. 6, 2001, which designates the United States.

TECHNICAL FIELD OF THE INVENTION

The invention relates to a fuel injection nozzle for an internal combustion engine.

BACKGROUND OF THE INVENTION

A fuel injection nozzle of this kind used in injection systems for injecting fuel under high pressure into the combustion chamber of an internal combustion engine is known, for example, from EP-B-0 637 686. This injection nozzle has a nozzle body and a nozzle holder which are screwed together by means of a lock nut with interposed stop shim. Mounted in a guide bore of the nozzle body is an axially displaceable valve needle which seals injection ports disposed in a valve seat at the lower end of the guide bore in the idle state. The guide bore of the valve needle is additionally widened at one point to form a pressure chamber to which fuel is fed at high pressure via an inlet bore. In the region of the pressure chamber, the valve needle has a pressure shoulder to which the highly pressurized fuel can be applied. In a blind bore in the nozzle holder there is disposed a pressure pin loaded by helical compression springs. The pressure pin cooperates with the valve needle via a feed-through implemented in the stop shim and presses said valve needle onto the valve seat in the nozzle body with a preset holding force in the idle condition. However, if the fuel pressure exerted on the pressure shoulder of the valve needle exceeds this holding force in the pressure chamber of the nozzle body, the valve needle lifts from the valve seat and moves axially in the direction of the stop shim until the end face of the valve needle strikes the stop shim, thereby limiting the maximum lift of the valve needle and therefore the amount of fuel injected. For implementing travel limiting for the valve needle, the adjacent surfaces of the stop shim, the nozzle holder and the nozzle body are implemented precisely level in order to ensure reliable sealing to the outside against the fuel which is at a pressure of up to 1500 bar. However, such planicity of the adjacent surfaces is difficult to achieve.

WO 00/60233 discloses a fuel injection valve for a common rail fuel injection system having a plurality of injector modules which are disposed axially one above the other and are axially tensioned against each other with a union nut, the two touching end faces of two successive injector modules forming sealing surfaces. In order to reduce the amount of sealing surface to be machined and therefore the manufacturing costs, the end face of an injector module, for example of a stop element, is provided with a recess of low planicity, said recess being produced in the end face of the injector module by laser ablation or electron beam ablation. However, with the known methods, only one end face of the injector module can be processed at a time, which means that the production process is time-consuming and therefore expensive.

SUMMARY OF THE INVENTION

The object of the invention is to provide a fuel injection nozzle wherein the sealing surfaces on a stop element can be manufactured quickly and precisely.

This object can be achieved by a method for producing a fuel injection nozzle for an internal combustion engine, comprising the steps of:

providing a nozzle body in which a valve needle with a stop is displaceably disposed, providing a nozzle holder in which a pressure pin is displaceably disposed, and providing a disk-shaped stop element in a region between the nozzle body and the nozzle holder, axially tensioning the nozzle body and the nozzle holder against one another in such a way that the stop element forms a first sealing surface which bears on a nozzle holder section, and a second sealing surface which bears on a nozzle body section, and producing at least one cutout in the two sealing surfaces in a single manufacturing operation.

The object can also be achieved by a method for manufacturing a fuel injection nozzle for an internal combustion engine, comprising the steps of:

disposing a valve needle with a stop displaceably within a nozzle body, disposing a pressure pin displaceably within a nozzle holder, providing a disk-shaped stop element in a region between the nozzle body and the nozzle holder, axially tensioning the nozzle body and the nozzle holder against one another in such a way that the stop element forms a first sealing surface which bears on a nozzle holder section, and a second sealing surface which bears on a nozzle body section, and producing at least one cutout in the two sealing surfaces in a single manufacturing operation.

The cutout can be punched, drilled and/or stamped. The cutout extends all the way through the stop element from the first to the second sealing surface. The method may further comprise the step of deepening the cutout by a predetermined axial depth in the first and the second sealing surface. The cutout may have a circular, oval or polygonal shape. The method may further comprise the step of providing the cutout in the edge region of the stop element.

Furthermore, the object can be achieved by a fuel injection nozzle for an internal combustion engine, comprising a nozzle body in which a valve needle with a stop is displaceably disposed, a nozzle holder in which a pressure pin is displaceably disposed, and a disk-shaped stop element which is provided in a region between the nozzle body and the nozzle holder, wherein the nozzle body and the nozzle holder being axially tensioned against one another in such a way that the stop element forms a first sealing surface which bears on a nozzle holder section, and a second sealing surface which bears on a nozzle body section, wherein the first and the second sealing surfaces each incorporate at least one cutout for the purpose of increasing the contact pressure of the sealing surfaces, and wherein the bilateral cutouts being implemented evenly opposite one another in the sealing surfaces.

The cutout may extend all the way through the stop element from the first to the second sealing surface. The cutout can be deepened by a predetermined axial depth in the first and the second sealing surface. The cutout may have a circular, oval or polygonal shape. The cutout can be provided in the edge region of the stop element.

Accordingly, a disk-shaped stop element disposed in a region between a nozzle body and a nozzle holder has sealing surfaces with at least one cutout on both sides. Through the provision of the cutouts, the surface areas of the two sealing surfaces on the end faces of the stop element are reduced, causing an increased contact pressure between, on the one hand, a nozzle holder section and the first sealing surface lying opposite thereto and, on the other, between a nozzle body section and the second sealing surface lying opposite thereto. Because of the smaller first and second sealing surface compared to an overall end face of the stop element, a high contact pressure and a high-pressure-tight connection is produced when the nozzle holder and the nozzle body are pretensioned against one another. This ensures, even with a high fuel pressure, a reliable seal between the nozzle holder section on the end face of the nozzle holder and the first sealing surface of the stop element as well as between the second sealing surface of the stop element and the nozzle body section on the end face of the nozzle body.

According to the invention, the cutouts in the first and second sealing surfaces are punched, drilled and/or stamped. This means that the process for producing the cutout is very quick and therefore inexpensive. Particularly in the case of punching, a cutout can be produced in the stop element with high precision and in any shape. With production of the cutout according to the invention by means of punching, drilling and/or stamping, it is possible to make the cutouts in both sealing surfaces simultaneously in a single operation, so that the production process for the sealing surfaces on the stop element is considerably simplified.

For low-cost production it has been found advantageous if the cutout runs all the way through the disk-shaped stop element from the first to the second sealing surface, the bilateral cutouts being easily manufacturable by punching or drilling of the stop element. In contrast to milling of the cutouts, punching allows greater geometrical scope for creating the sealing surfaces while at the same time reducing production costs.

According to another implementation of the invention it is preferred that the cutout is implemented in such as way that it is deepened by a predetermined amount in the first and the second sealing surface, the cutouts on the first and the second sealing surface being possibly provided by bilateral stamping, for example. Bilateral stamping in turn ensures machining of two sealing surfaces in a single operation.

To achieve an even contact pressure on the first and/or second sealing surface of the stop element, it has been found advantageous if the cutout has a circular, oval or polygonal shape. Contours of this kind can be quickly and precisely produced by means of punching, it being possible to selectively influence the contact pressure exerted by the sealing surfaces on the opposite nozzle holder section or nozzle body section by means of a predefined shaping of the cutout.

In certain applications it offers advantages if the cutout is provided bilaterally in the edge region of the sealing surfaces of the stop element. This increases the contact pressure in the inner region of the first and the second sealing surface.

BRIEF DESCRIPTION OF THE DRAWINGS

The invention will now be explained in greater detail with reference to the accompanying drawings.

DETAILED DESCRIPTION OF THE PREFERRED EMBODIMENTS

Figure 1:
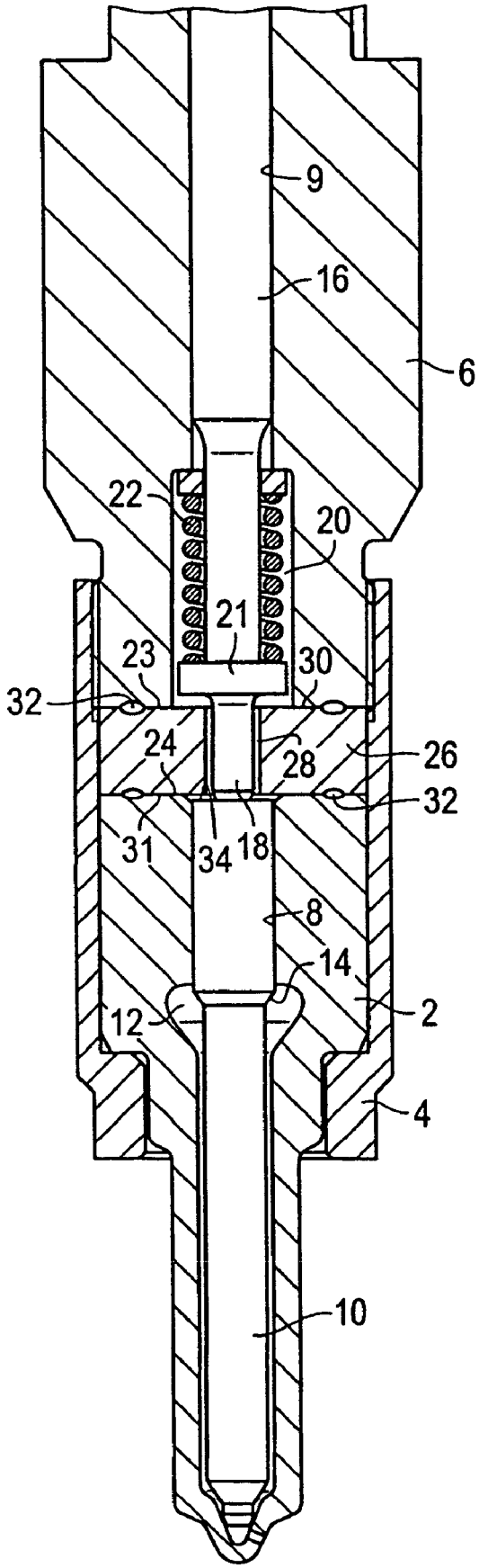
FIG. 1 shows a longitudinal section through a first embodiment of the fuel injection nozzle according to the invention.

FIG. 1 shows an essentially rotationally symmetrical fuel injection nozzle in a first embodiment wherein a nozzle body 2 is tensioned against a nozzle holder 6 by a union nut 4. In a first guide bore 8 in the nozzle body 2 a valve needle 10 is displaceable mounted in the axial direction. At its front end, the valve needle 10 is provided with an essentially conical tip which cooperates with the valve seat in the nozzle body 2 which has a plurality of injection ports (not shown). In a central area the guide bore 8 is widened to form a pressure chamber 12 in which the valve needle 10 has a pressure shoulder 14. The pressure chamber 12 is connected to a high-pressure inlet bore (not shown) implemented in the nozzle body 2 and via which fuel is fed under high pressure to the pressure chamber 12.

The nozzle holder 6 has a second guide bore 9 whose longitudinal axis is in line with the longitudinal axis of the first guide bore 8 in the nozzle body 2. There is additionally implemented in the walls of the nozzle holder 6 a high-pressure inlet bore (not shown) which is connected to the high-pressure inlet bore in the nozzle body 2 in order to feed in fuel. There is provided in the second guide bore 9 in the nozzle holder 6 a pressure pin 16 that can be displaced axially and which is in active connection with a drive (not shown) which applies a required holding pressure to the pressure pin 16. This drive can be provided electromagnetically or piezoelectrically or even by means of a spring mechanism.

The pressure pin 16 acts on the valve needle 10 via an interposed transmission body 18, the valve needle 10, the pressure pin 16 and the transmission body 18 being disposed in axial alignment in order to achieve good power transmission. In the front area of the second guide bore 9 there is implemented a spring chamber 20 in which a spring force adjustment disk 21 is disposed. On the 21 spring force adjustment disk, a helical spring 22 is supported at one end. The other end of the helical spring 22 cooperates with an end face of the transmission body 18, said helical spring 22 being designed in such a way that, in the unpressurized state when no fuel pressure is present in the pressure chamber of the nozzle body 2, it presses the valve needle 10, via the transmission body 18, against the valve seat in the nozzle body 2, thereby preventing fuel from being injected.

A disk-shaped stop element 26 is inserted between opposite end faces of the nozzle holder 6 and of the nozzle body 2, said stop element 26 having a central feed-through 28 through which the transmission body 18 protrudes sectionally as the active connection between the pressure pin 16 and the valve needle 10. The stop element 26 is of annular form and fastened via fixing bores 32 to the nozzle holder 6 on the one hand and to the nozzle body 2 on the other. The stop element 26 has a first, upper sealing surface 30 which bears on a nozzle holder section 23 on the end face of the nozzle holder 6, and a second, lower sealing surface 31 which bears on a nozzle body section 24 on the end face of the nozzle body 2. The nozzle holder section 23 and the nozzle body section 24 in each case form sealing surfaces which cooperate with the sealing surfaces 30, 31 on the end faces of the stop element 26, the nozzle union nut 4 which engages a shoulder of the nozzle body 2 and presses the nozzle body 2 axially in the direction of the nozzle holder 6, providing axial pretensioning of the nozzle holder 6, of the stop element 26 and of the nozzle body 2 against one another, thereby producing a high contact pressure at their end faces. This means that the high-pressure inlet bores as well as the guide bores 8, 9 and the feed-through 28 are reliably sealed against each other and to the outside.

At its end opposite the transmission body 18, the valve needle 10 has a stop 34. In the idle position the valve needle 10 is seated on the valve seat because of the holding pressure acting via the pressure pin 16 on the transmission body 18 and the valve needle 10 and closes the injection ports so that no fuel is injected into the internal combustion engine. If the fuel pressure which is present in the pressure chamber 12 of the guide bore 8 and which acts on the pressure shoulder 14 on the valve needle 10 exceeds the holding pressure acting on the valve needle 10 via the pressure pin 16 and the transmission body 18, the valve needle 10 lifts from the valve seat and moves axially against the pressure pin 16 and the transmission body 18 until the stop 34 of the valve needle 10 strikes the stop element 26, thereby limiting the maximum travel of the valve needle 10. This maximum travel essentially determines the amount of fuel injected via the injection ports. The stop element 26 disposed between the end face 23 of the nozzle holder 6 and the end face 24 of the nozzle body 2 provides a simple means of meeting the required tolerances for the maximum travel. The stop element 26 can be manufactured as a simple turned part, e.g. made of hardened steel, the bilateral end faces of the stop element 26 being implemented as sealing surfaces 30, 31 having at least one cutout (not shown in FIG. 1). By means of the cutouts, a surface area of the sealing surfaces 30, 31 is reduced and the sealing effect is increased.

Figure 2:
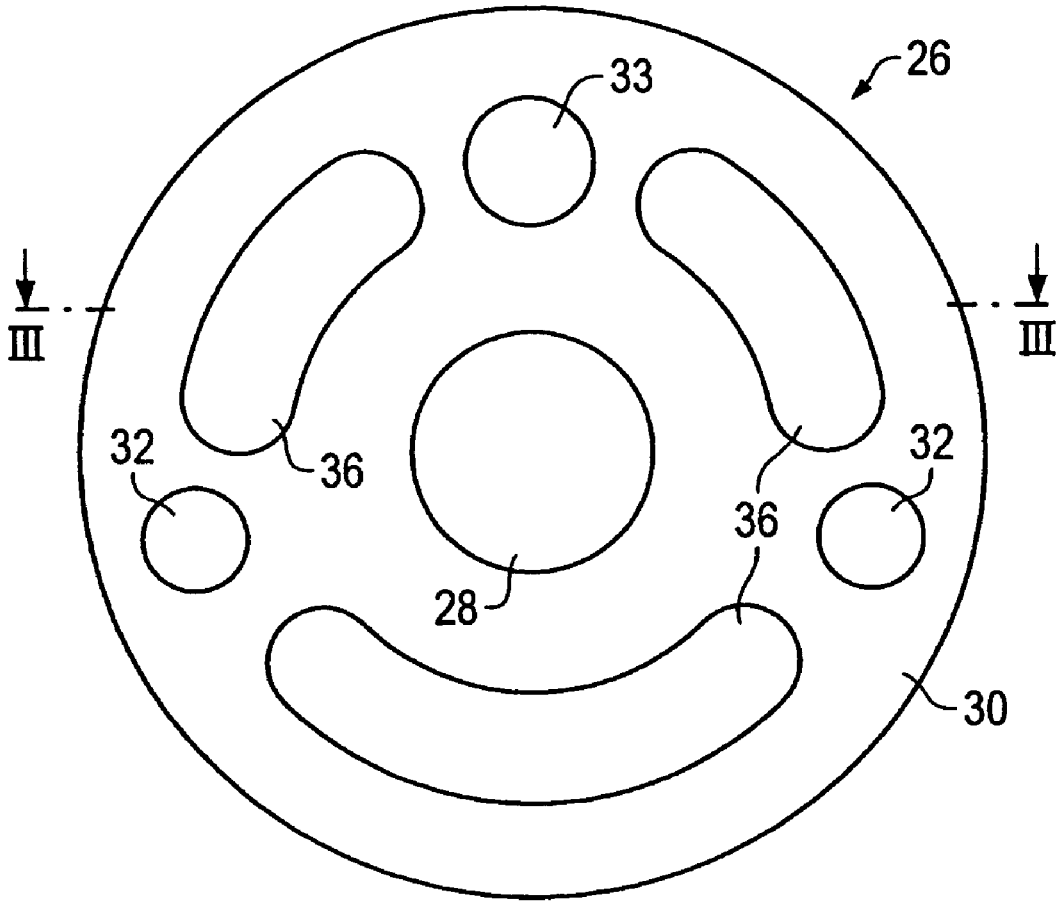
FIG. 2 shows a plan view of a stop element of a fuel injection nozzle in a second embodiment.

FIG. 2 shows a plan view of a stop element 26 of a fuel injection nozzle. FIG. 2 provides a top view of the upper, first sealing surface 30 of the stop element 26. The stop element 26 has at its center the feed-through 28 for the transmission body (not shown in FIG. 2) which protrudes through the feed-through 28 in the installed condition. Additionally provided in this disk-shaped stop element 26 are two oval cutouts 36 disposed mirror-symmetrically on the sealing surface 30. In addition, a third kidney-shaped cutout 36 is implemented in the sealing surface 30. To attach the stop element 26 to the end faces of the nozzle holder 6 and of the nozzle body 2, two fixing bores 32 are distributed over the sealing surface 30. A fuel inlet bore 33 is additionally provided in the stop element 26.

Figure 3:
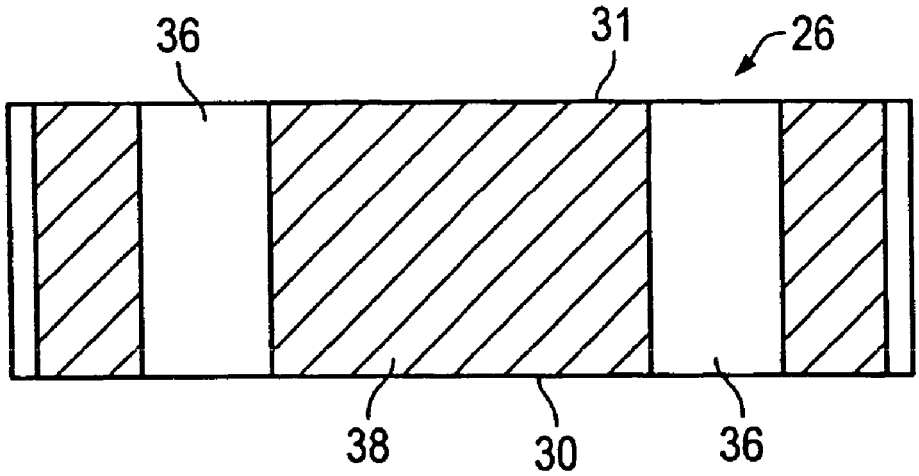
FIG. 3 shows a sectional view of the stop element from FIG. 2 along the line III—III.

In FIG. 3 shows a sectional view of the stop element 26 shown in FIG. 2 along the line III—III. As can be seen from FIG. 3, the cutouts 36 in the first sealing surface 30 extend all the way through the thickness of the stop element 26 from the first sealing surface 30 to the second sealing surface 31. This extending of the cutouts 36 all the way through can be achieved quickly in a simple and precise manner by punching them out from the material of the stop element 26. Between the cutouts implemented as punchings there is provided a web 38 which provides a stop surface for the stop 34 of the valve needle 10.

Figure 4:
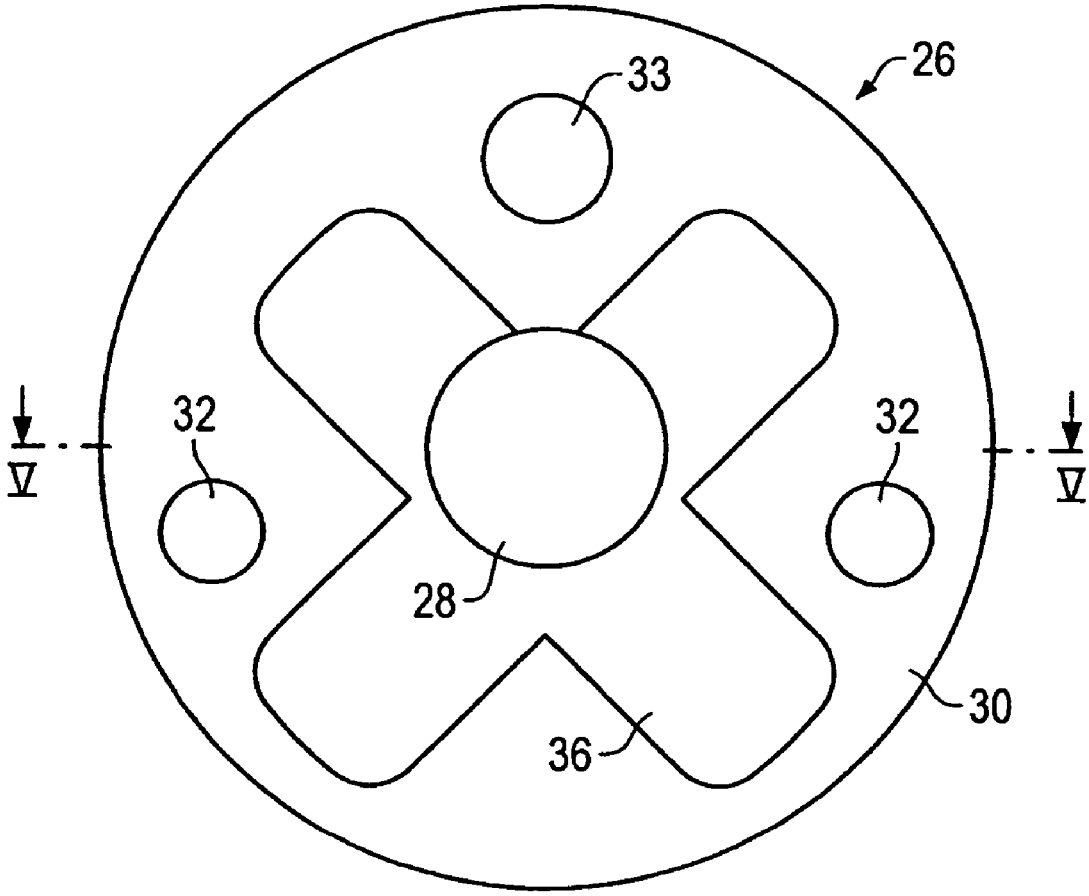
FIG. 4 shows a plan view of a stop element of a fuel injection nozzle in a third embodiment.

FIG. 4 illustrates a stop element 26 of a fuel injection nozzle according to a third embodiment. As can be seen from the plan view of the first sealing surface 30 of the stop element 26, in this case an individual cutout 36 is implemented on the sealing surface 30. The cutout 36 has a polygonal shape which is implemented evenly over the sealing surface 30 and is mirror-symmetrical about the two central axes of the essentially circular stop element 26. Two fixing bores 32 and a fuel inlet bore 33 are provided in the edge region of the stop element 26.

Figure 5:
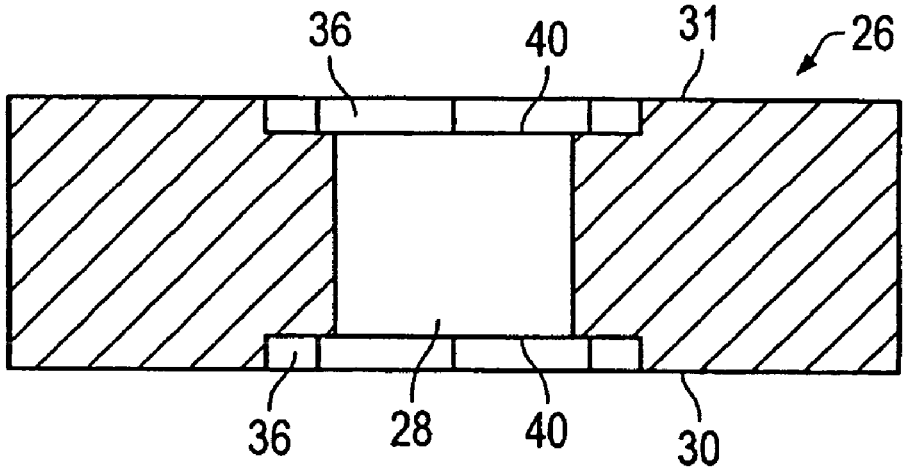
FIG. 5 shows a sectional view of the stop element from FIG. 4 along the line V—V.

FIG. 5 shows a sectional view of the stop element 26 along the line V—V according to FIG. 4, the cutout 36 being provided in the stop element 26 both on the upper, first sealing surface 30 and on the lower, second sealing surface 31. In the center of the stop element 26 is the feed-through 28 for the transmission body. The cutout 36 has a predetermined axial depth h of at least 0.02 mm in each sealing surface 30, 31. Each cutout 36 therefore incorporates non-bearing and therefore non-sealing surface regions 40 which are made deeper compared to the sealing surfaces 30, 31 so that an axial height difference exists between each sealing surface 30, 31 and the surface region 40 of the cutout 36.

Figure 6:
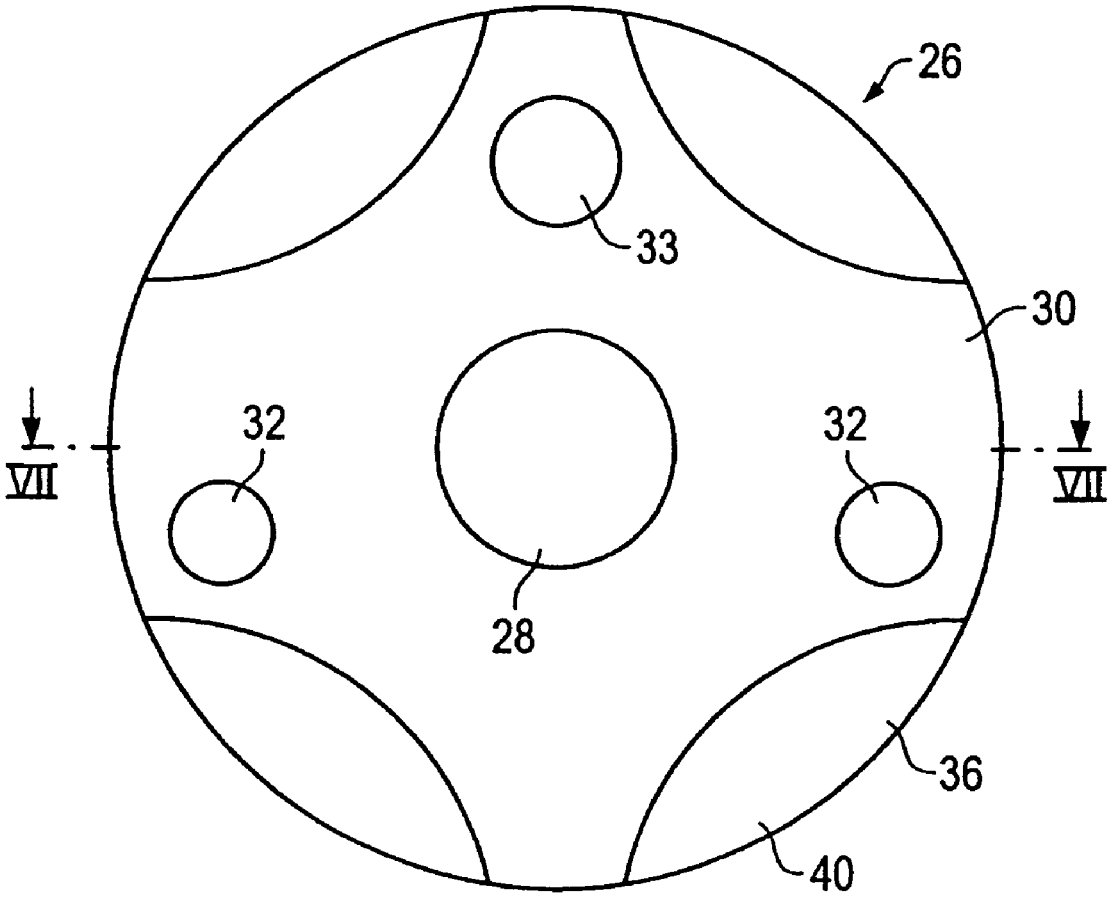
FIG. 6 shows a plan view of a stop element of a fuel injection nozzle in a fourth embodiment.

FIG. 6 shows a plan view of another embodiment of the stop element 26 wherein the four cutouts 36 are formed in the edge region of the sealing surface 30. The cutouts 36 are in this case semicircular and disposed mirror-symmetrically about both central axes of the disk-shaped stop element 26, the shape of the cutouts 36 according to FIGS. 4 to 6 being produced, for example, by bilateral stamping of the stop element 26.

Figure 7:
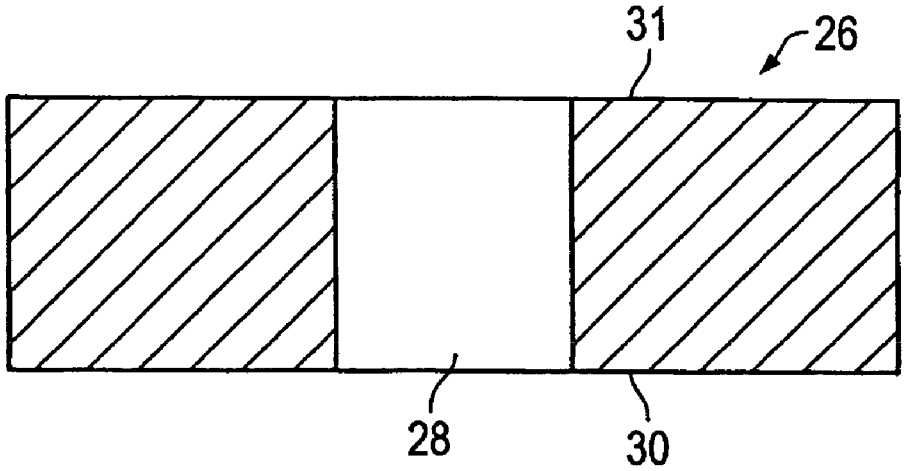
FIG. 7 shows a sectional view of the stop element from FIG. 6 along the line VII—VII.

FIG. 7 shows a sectional view of the stop element 26 along the line VII—VII according to FIG. 6, the feed-through 28 extending from the first sealing surface 30 all the way through the stop element 26 to the second sealing surface 31. The sealing surfaces 30, 31 are raised compared to the surface regions 40 of the cutouts 36.

What is claimed is:

1. A method for producing a fuel injection nozzle for an internal combustion engine, said method comprising:

providing a nozzle body having a valve needle with a stop displaceably disposed therein, providing a nozzle holder having a pressure pin displaceably disposed therein, and providing a disk-shaped stop element in a region between the nozzle body and the nozzle holder, said stop element having a fuel inlet bore therein, axially tensioning the nozzle body and the nozzle holder against one another such that the stop element forms a first sealing surface bearing on a nozzle holder section, and a second sealing surface bearing on a nozzle body section, and producing at least one cutout in the two sealing surfaces in a single manufacturing operation, wherein said at least one cutout is separated from said fuel inlet bore.

2. A method according to claim 1, wherein the cutout is a punched, drilled or stamped cutout.

3. A method according to claim 1, wherein the cutout extends all the way through the stop element from the first to the second sealing surface.

4. A method according to claim 1, further comprising the step of deepening the cutout by a predetermined axial depth in the first and the second sealing surfaces.

5. A method according to claim 1, wherein the cutout has a circular, oval or polygonal shape.

6. A method according to claim 1, further comprising the step of providing the cutout in an edge region of the stop element.

7. A fuel injection nozzle for an internal combustion engine, said nozzle comprising:

a nozzle body having a valve needle with a stop displaceably disposed therein, a nozzle holder having a pressure pin displaceably disposed therein, and a disk-shaped stop element provided in a region between the nozzle body and the nozzle holder, said stop element having a fuel inlet bore therein, wherein the nozzle body and the nozzle holder are axially tensioned against one another such that the stop element forms a first sealing surface bearing on a nozzle holder section, and a second sealing surface bearing on a nozzle body section, wherein the first and the second sealing surfaces each incorporate at least one cutout for increasing the contact pressure of the sealing surfaces, and the cutouts being implemented evenly opposite one another in the sealing surfaces and separated from said fuel inlet bore.

8. A fuel injection nozzle according to claim 7, wherein the cutout extends all the way through the stop element from the first to the second sealing surfaces.

9. A fuel injection nozzle according to claim 7, wherein the cutout is deepened by a predetermined axial depth in the first and the second sealing surface.

10. A fuel injection nozzle according to claim 7, wherein the cutout has a circular, oval or polygonal shape.

11. A fuel injection nozzle according to claim 7, wherein the cutout is provided in an edge region of the stop element.

12. A method for manufacturing a fuel injection nozzle for an internal combustion engine, said method comprising:

displaceably disposing a valve needle with a stop within a nozzle body, displaceably disposing a pressure pin within a nozzle holder, providing a disk-shaped stop element in a region between the nozzle body and the nozzle holder, said stop element having a fuel inlet bore therein, axially tensioning the nozzle body and the nozzle holder against one another such that the stop element forms a first sealing surface bearing on a nozzle holder section, and a second sealing surface bearing on a nozzle body section, and producing at least one cutout in the two sealing surfaces in a single manufacturing operation, wherein said at least one cutout is separated from said fuel inlet bore.

13. A method according to claim 12, wherein the cutout is a punched, drilled or stamped cutout.

14. A method according to claim 12, wherein the cutout extends all the way through the stop element from the first to the second sealing surface.

15. A method according to claim 12, further comprising the step of deepening the cutout by a predetermined axial depth in the first and the second sealing surfaces.

16. A method according to claim 12, wherein the cutout has a circular, oval or polygonal shape.

17. A method according to claim 12, further comprising the step of providing an cutout in the edge region of the stop element.

* * * * *